US006199454B1

(12) United States Patent
Bergbower

(10) Patent No.: US 6,199,454 B1
(45) Date of Patent: Mar. 13, 2001

(54) SOCKET WRENCH HAVING A ROTATABLE HANDLE

(75) Inventor: Robert Bergbower, 2017 S. August, Stillwater, OK (US) 74074

(73) Assignee: Robert Bergbower, Stillwater, OK (US)

( * ) Notice: Subject to any disclaimer, the term of this patent is extended or adjusted under 35 U.S.C. 154(b) by 0 days.

(21) Appl. No.: 09/364,678

(22) Filed: Jul. 30, 1999

(51) Int. Cl.[7] ..... B25B 13/46; B25G 1/08
(52) U.S. Cl. ..... 81/60; 81/177.4
(58) Field of Search ..... 81/60, 177.4, 490, 81/492

(56) References Cited

U.S. PATENT DOCUMENTS

| | | | |
|---|---|---|---|
| 1,289,558 | 12/1918 | Sedgley . | |
| 1,371,350 | 3/1921 | Campbell . | |
| 1,416,461 | 5/1922 | Hance . | |
| 1,469,589 * | 10/1923 | Palmer | 81/177.4 |
| 1,662,424 | 3/1928 | Judge . | |
| 2,776,589 | 1/1957 | Gregory . | |
| 4,253,356 | 3/1981 | Martinmaas . | |
| 4,352,307 * | 10/1982 | Martinmaas | 81/177.4 |
| 4,798,111 | 1/1989 | Cheeseman . | |
| 4,960,016 * | 10/1990 | Seals | 81/177.4 |
| 5,687,802 | 11/1997 | Spooner et al. . | |

* cited by examiner

*Primary Examiner*—David A. Scherbel
*Assistant Examiner*—Joni B. Danganan
(74) *Attorney, Agent, or Firm*—Dunlap, Codding & Rogers, P.C.

(57) ABSTRACT

A socket wrench having a head and a shank extending therefrom, a drive shaft supported by the head portion adaptable for engagement with a tool element to rotate a fastener, a journal surface on the shank adaptable for a journalled engagement with a plurality of tool elements to provide a rotatable handle and a retaining member to retain the rotatable handle on the shank.

24 Claims, 4 Drawing Sheets

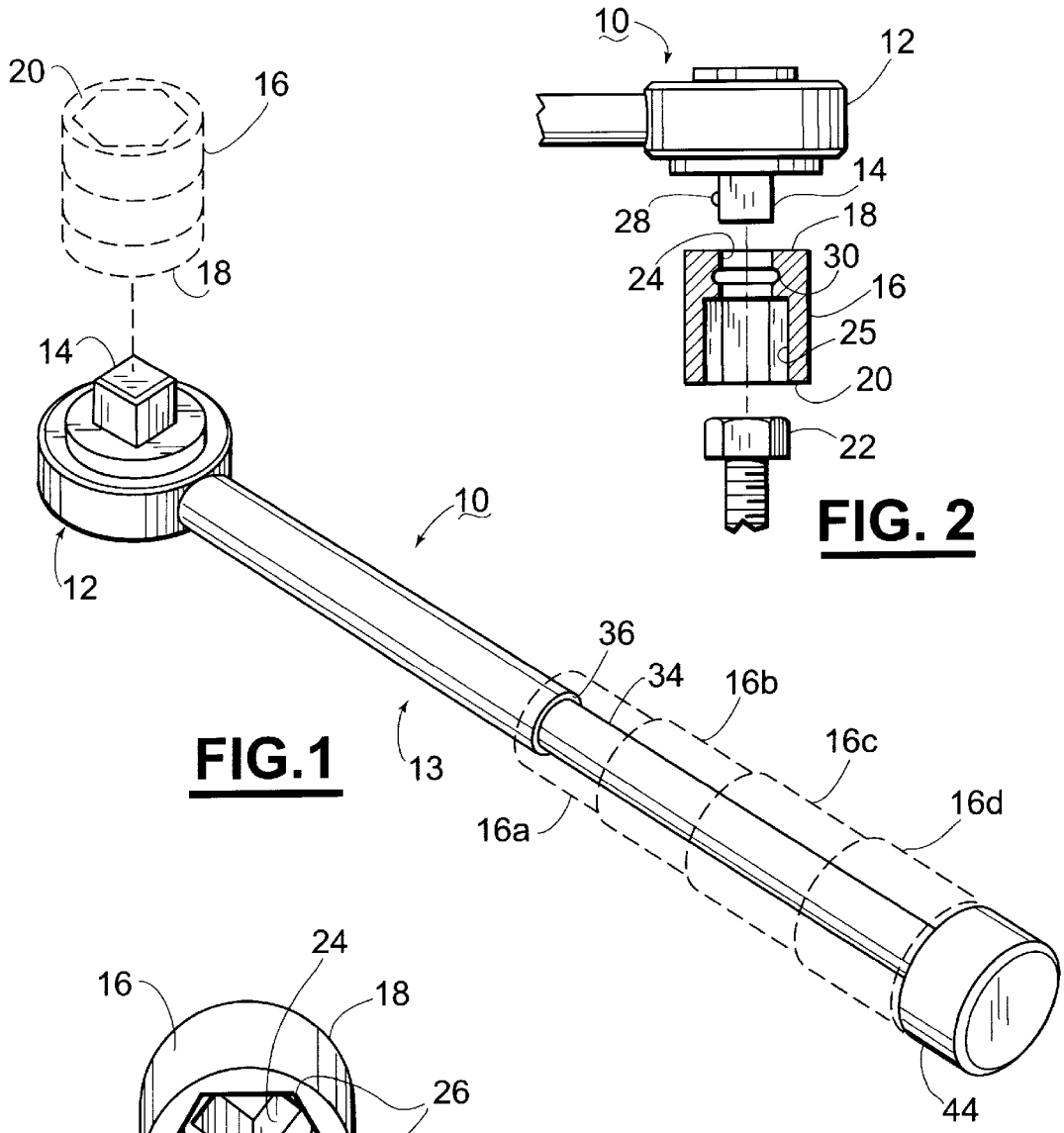
FIG.1
FIG. 2
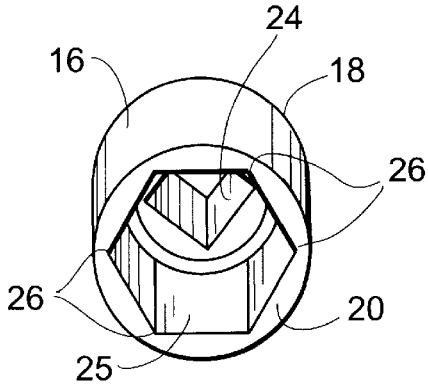
FIG.3

SOCKET WRENCH HAVING A ROTATABLE HANDLE

FIELD OF THE INVENTION

The present invention relates generally to the field of hand tools, and more particularly but not by way of limitation, to a socket wrench having spare tool elements operatively providing a rotatable handle portion of the socket wrench.

SUMMARY OF THE INVENTION

The present invention provides a socket wrench for installing and removing fasteners. The socket wrench has a head and a shank extending therefrom, the shank providing a lever against which a user grasps with a hand-hold and exerts a force to impart a torque on the head. A tool element is coupled to the head to transfer the torque to the fastener so as to install or remove the fastener.

The shank has a journal surface about which is journalled a plurality of spare tool elements in order to provide a rotatable handle about the shank. A retaining member attaches to the shank to retain the tool elements in the journalled engagement about the shank.

The rotatable handle facilitates a characteristic neutral wrist position by an operator using the socket wrench. This resultingly reduces bent-wrist repetitive motion and the associated cumulative trauma disorders of the hand and wrist.

BRIEF DESCRIPTION OF THE DRAWINGS

FIG. 1 is an isometric view illustrating a socket wrench constructed in accordance with an embodiment of the present invention.

FIG. 2 is an exploded sectional view illustrating a portion of the socket wrench of FIG. 1 in cooperation with a tool element interposed between the drive shaft of the socket wrench and a fastener.

FIG. 3 is an isometric view of the tool element of FIG. 2.

DETAILED DESCRIPTION

Figure 4:
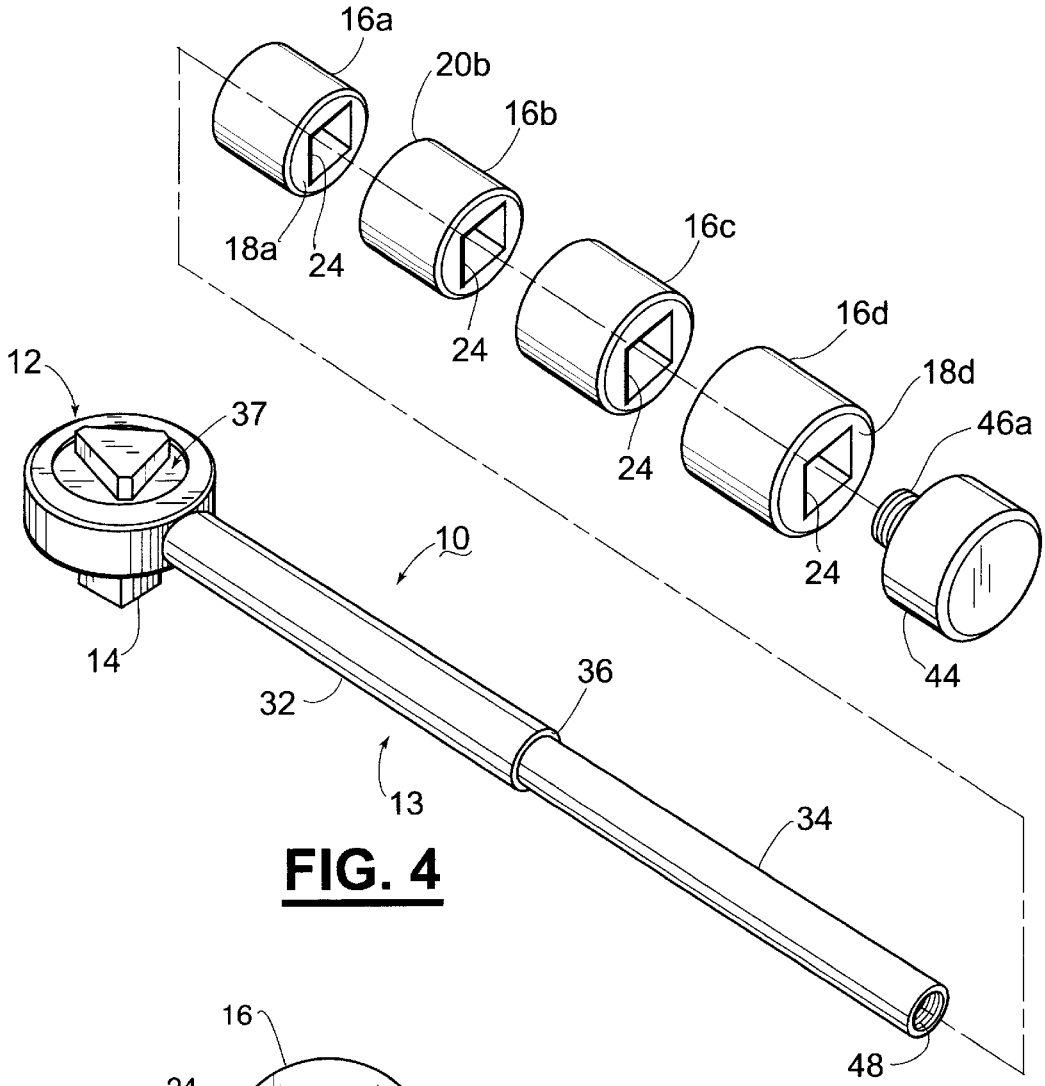
FIG. 4 is an exploded isometric view illustrating the manner in which tool elements are journalled on the shank and retained by the retaining member.

Turning now to the drawings and in particular to FIG. 1 which shows a tool apparatus 10, sometimes referred to as a socket wrench 10, that is constructed in accordance with an embodiment of the present invention. The tool apparatus 10 generally has a head 12 and a shank 13. The head 12 has a driving shaft 14 adapted for engaging a tool element 16 at a drive end 18 thereof. As shown in FIG. 2, an opposing socket end 20 of the tool element 16 is adapted for engagement with a fastener 22. In this manner, the tool apparatus 10 cooperates with the tool element 16 to rotate a fastener 22 so as to install or remove the fastener 22. Preferably, the tool element 16 is a standard socket of the type that is readily available in department and hardware stores.

One of skill in the art will recognize the general arrangement described hereinabove, wherein the driving shaft 14 of the tool apparatus 10 is substantially squarely shaped to accommodate standard sockets made for a ¼ inch, ½ inch, or a ¾ inch square drive.

More particularly, from FIGS. 2 and 3 it will be understood the drive end 18 of the tool element 16 has a square socket 24 to receivingly engage the driving shaft 14 so as to operatively couple the tool element 16 and the head 12. The socket end 20 of the tool element 16 has a multi-sided socket 25 to receivingly engage the fastener 22. FIG. 3 illustrates a tool element 16 with a multi-sided socket 25 having six sides referred to as a "six-point" socket, referencing the number of vertices 26 that are formed between adjacent sides of the multi-sided socket 25. The multi-sided socket 25 can have any desired number of sides and is thus more generally referred to as a polygonally-sided socket 25. It will be noted the sockets 24, 25 are contiguous to form a longitudinal bore through the tool element 16.

Returning briefly to FIG. 2, a retention ball 28 in the driving shaft 14 is biased against a detent 30 in the tool element 16 to frictionally retain the drive end 18 of the tool element 16 in operable engagement with the driving shaft 14.

Turning now to FIG. 4, it will be noted the shank 13 has a proximal end 32 attached to the head portion 12, the shank 13 extending therefrom substantially transversely along an orthogonal plane relative to the driving shaft 14. A plurality of tool elements 16*a*, 16*b*, 16*c*, 16*d* are stored on a distal portion of the shank 13 in a manner providing a rotatable handle for an operator to grasp. The plurality of tool elements 16*a*, 16*b*, 16*c*, 16*d* can be referred to as "spare" tool elements in that when the tool elements are stored on the shank 13 they are not presently in operative use in conjunction with the drive shaft 14 to engage a fastener 22. The shank 13 thus provides a lever-arm adapted for a self-contained storage of the spare tool elements, which, in turn, provide a rotatable handle for applying torque to the head 12.

Figure 5:
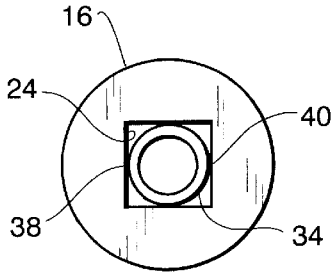
FIG. 5 is a partial sectional end view illustrating a tool element journalled about the journal surface of the shank.

The shank 13 has a relatively reduced diameter journal surface 34, and an abutment 36 is formed at a transition to the relatively reduced diameter. The journal surface 34 is a cylindrical surface having a circular cross-section with a radius appropriately sized so as to be slidingly disposable within the bore of the tool elements 16*a*–16*d*. FIG. 5 illustrates a relatively close-fitting journalled relationship between the journal surface 34 and the drive socket 24. In this manner the tool elements 16*a*–16*d* are supported so as to permit rotation thereof about the shank 13, and the tool elements 16*a*–16*d* thereby cooperatively provide a grippable surface of the rotatable handle. Alternatively, although not shown, the journal surface 34 can be adapted for a journalled relationship with the polygonally-shaped socket 25. FIG. 4 furthermore illustrates the head 12 as having a housing in which is disposed a ratchet assembly 37 to ratchet the operative coupling between the head 12 and the drive shaft 14; that is, a lever selectively ratchets the drive shaft 14 in response to a rotation of the head. The provision and use of the ratchet assembly 37 in a socket wrench is well known and as such a detailed description thereof is not necessary for an understanding of the present invention to one skilled in the art.

Figure 6:
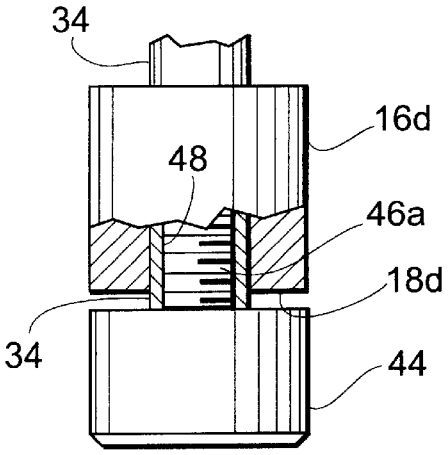
FIG. 6 is a diagrammatic partial-sectional view illustrating the retaining member threadingly engaging the shank.

The plurality of spare tool elements 16*a*–16*d* are thus aligned end-to-end along the journal surface 34 of the shank 13. The first tool element 16*a* is slidingly disposed along the journal surface 34 in a direction toward the head 12 until it engages the abutment 36. The tool element 16*b* is disposed along the journal surface 34 until it engages the drive end 18*a* of the first tool element 16*a*. The other spare tool elements follow in like manner. A retaining member 44 thereafter attaches to the distal end of the shank 13 to limit a longitudinal movement of the tool elements 16*a*–16*d* along the shank 13 and thereby retain the aligned tool elements 16*a*–16*d* in the journalled engagement about the journal surface 34. FIG. 4 illustrates a threaded engagement of a threaded post 46*a* of the retaining member 44 with an internal thread 48 provided in the distal end of the shank 13. It will be noted from FIG. 6 that the distal end of the shank 13 extends slightly beyond the drive end 18*d* of the outboard tool element 16*d* in order to provide a clearance gap between the retaining member 44 and the tool element 16*d*, so that the threaded engagement of the retaining member 44 and shank 13 does not interfere with the journalled rotation of the tool element 16*d* about the journal surface 34.

Figure 7:
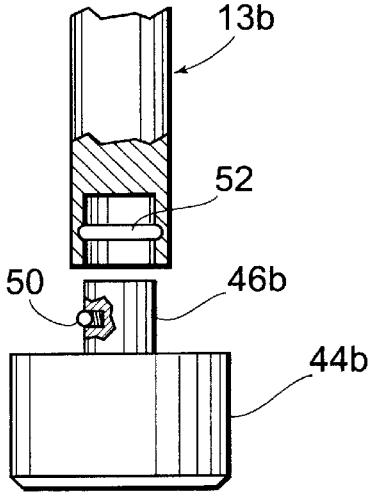
FIG. 7 is a diagrammatic partial-sectional view illustrating the retaining member and shank constructed in accordance with an alternative embodiment adapted for a ball and detent frictional engagement.
Figure 8:
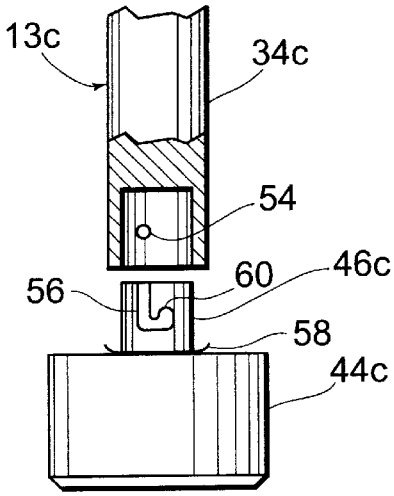
FIG. 8 is a diagrammatic partial-sectional view illustrating the retaining member and shank constructed in accordance with an alternative embodiment adapted for a pin and detent engagement.
Figure 9:
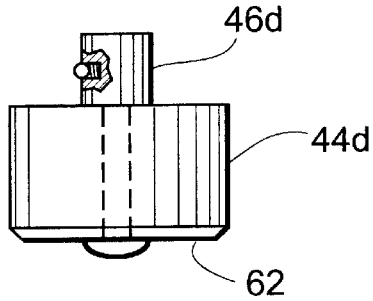
FIG. 9 is an elevational view illustrating the retaining member with a rotating shoulder for a ball and detent engagement as in FIG. 7.

FIG. 7 illustrates one example of an alternative embodiment wherein a biased member 50 in a post 46*b* of a retaining member 44*b* frictionally engages a detent 52 in the distal end of a shank 13*b*. FIG. 8 illustrates another embodiment wherein a frictional engagement of a protruding pin 54 in the distal end of a shank 13*c* is receivingly engaged in a slot 56 provided in a post 46*c* of a retaining member 44*c*. A compression washer 58 is employed to bias the pin 54 within a detent 60 provided in a distal end of the slot 56. FIG. 9 furthermore illustrates another fastening member 44*d* similar to that contemplated in FIG. 7, wherein the retaining member 44*d* has a shoulder 62 that is pinned to the post 46*d*. In this manner the shoulder 62 is rotatable relative to the post 46*d* so as to freely rotate with the plurality of spare tool elements 16*a*–16*d*.

The alternative constructions of the retaining member 44 previously discussed and illustrated in FIGS. 7–9 are illustrative of the contemplated scope of the present invention with regard to the retaining member 44 and its function in providing an easily detachable supporting member to retain the tool elements 16 on the shank 13. The illustrated alternative embodiments are indicative of and in no way enumerative of the alternative constructions embodied within the spirit of the present invention, which in no way is limited in scope to the explicit alternative constructions discussed.

Figure 10:
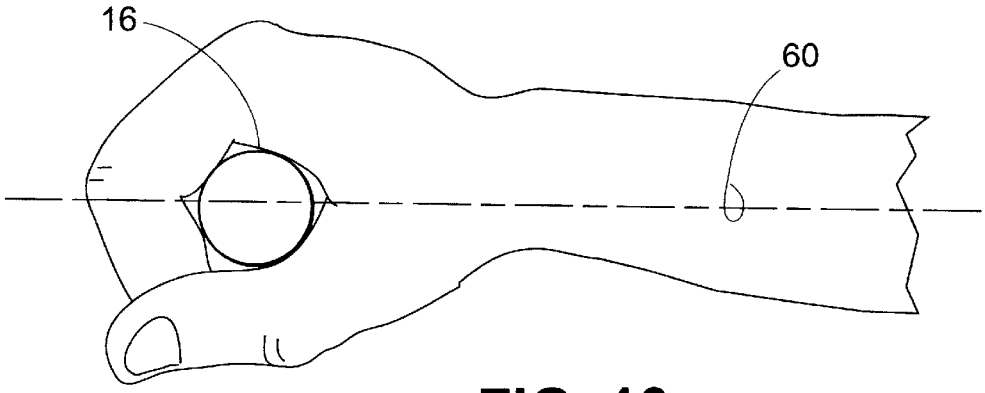
FIG. 10 is a diagrammatic view of a user's wrist in a neutral position as is facilitated by the rotatable handle.
Figure 11:
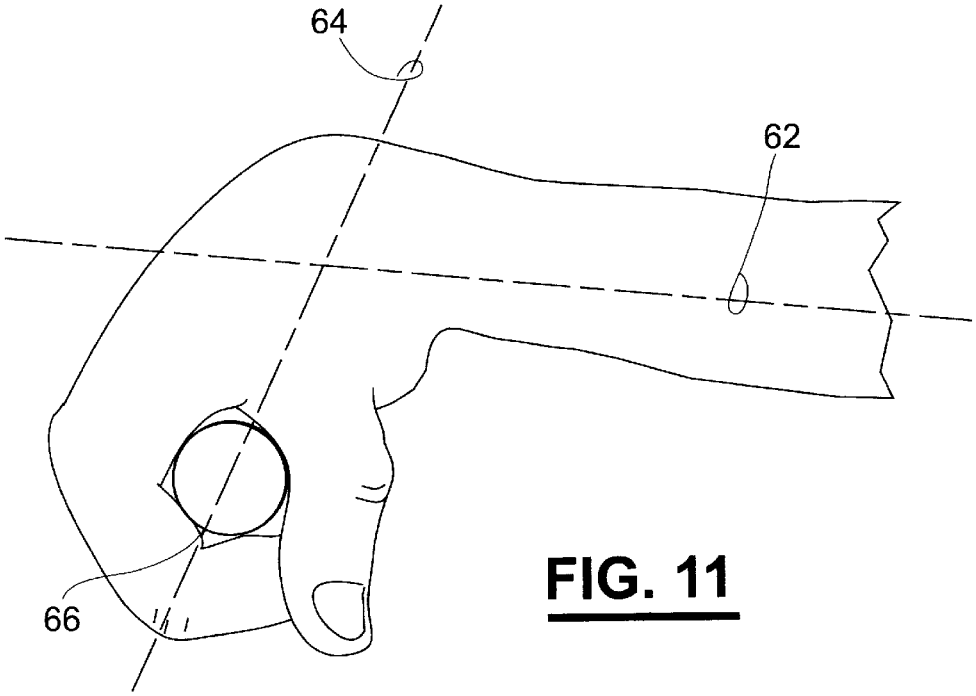
FIG. 11 illustrates a non-neutral position.

Having provided a discussion of the construction of the tool apparatus 10 in combination with a number of tool elements 16 hereinabove, attention now will be directed to the use of the tool apparatus 10. One of the benefits associated with providing a rotatable handle on the tool apparatus 10 is to facilitate a neutral position of a user's wrist during operation. FIG. 10 diagrammatically illustrates the neutral position of a user's wrist wherein the wrist is substantially unbent so that the user's forearm and hand are coplanar as shown in FIG. 10 by the plane denoted by the numeral 60. The rotatable handle provided by the journalled tool elements 16 about the journal surface 34 of the shank 31 facilitate this neutral wrist position. FIG. 11 illustrates a non-neutral wrist position wherein the wrist is bent so that the user's forearm and hand lie in different planes as denoted by the planes 62, 64, such as is facilitated by a conventional solid, non-rotatable handle 66 of a prior art socket wrench.

A socket wrench is typically grasped by the user who exerts a turning force along an arcuate path of hand travel. Especially in ratcheting type socket wrenches, repeated motion along this arcuate path tends to impart a rocking motion of the hand bending at the wrist. Repetitive bent-wrist motion is known to cause cumulative trauma disorders such as carpal tunnel syndrome. The rotatable handle of the present invention facilitates a gripping action of the tool apparatus 10 and use thereof with the wrist at a neutral position to diminish the cumulative trauma injuries associated with improper wrist positioning.

These and other advantages and features of the present invention will be apparent to one of skill in the art from the foregoing description when read in conjunction with the drawings and appended claims. It is to be understood that even though numerous characteristics and advantages of various embodiments of the present invention have been set forth in the foregoing description, together with details of the structure and function of various embodiments of the invention, this disclosure is illustrative only, and changes may be made in details especially in matters of structure and arrangement of parts within the principles of the present invention to the full extent indicated by the broad general meaning of the terms in which the appended claims are expressed.

Changes may be made in the embodiments of the invention described herein, or in parts or elements of the embodiments described herein, or in the sequence of steps of the methods described herein, without departing from the spirit and/or scope of the invention as defined in the following claims.

What is claimed is:

1. A socket wrench adapted to facilitate a neutral wrist position during use of the socket wrench, comprising:

a plurality of tool elements;

a head having a drive shaft connectable to the tool elements for interchangeable coupling engagement with one of the plurality of tool elements;

an elongated shank extending substantially transversely from the head and having a journal surface adaptable for a journalled engagement with the tool elements about the shank, the plurality of tool elements rotatably disposed on the journal surface of the shank; and a retaining member attached to the shank for retaining the tool elements about the shank.

2. The socket wrench of claim 1 wherein the head supports a ratchet assembly for selectively ratcheting the drive shaft in response to rotation of the head.

3. The socket wrench of claim 1 wherein the drive shaft engages a first socket of a first tool element and a fastener engages a second socket of the first tool element, the first and second sockets contiguously forming a longitudinal bore through the tool element, wherein the journal surface is adapted to be disposed within the longitudinal bore.

4. The socket wrench of claim 3 wherein the journal surface comprises a substantially cylindrically-shaped surface having a substantially circular cross-section that is adapted for journalling the first socket of the tool element, wherein the first socket is substantially squarely-shaped.

5. The socket wrench of claim 3 wherein the journal surface comprises a substantially cylindrically-shaped surface having a substantially circular cross-section that is adapted for journalling the second socket of the tool element, wherein the second socket is substantially polygonally-shaped.

6. The socket wrench of claim 1 wherein the distal end of the shank is provided with a threaded surface and the retaining member comprises:

a threaded post adapted for a threading engagement with the shank; and a shoulder depending from the post to abuttingly limit a longitudinal movement of the tool element in order to retain the tool element in the journalled engagement about the shank.

7. The socket wrench of claim 1 wherein the distal end of the shank is provided with a detent and the retaining member comprises:

a post supporting a spring-biased ball adapted for a frictional engagement with the shank; and a shoulder depending from the post to abuttingly limit a longitudinal movement of the tool element in order to retain the tool element in the journalled engagement about the shank.

8. The socket wrench of claim 1 wherein the distal end of the shank is provided with an extending pin and the retaining member comprises:

a post having a slot for a receiving engagement with the pin, the slot terminating in a detent for retaining the pin; and a bias member urging the pin to remain in the detent.

9. A socket wrench, comprising:

a head having a drive shaft adaptable for a coupling engagement interchangeably with any one of a plurality of tool elements;

a shank extending substantially transversely from the head and having a journal surface adaptable for a journalled engagement with the tool elements about the shank, so as to permit a rotation of the tool elements about the shank to provide a rotatable grippable surface for the socket wrench; and a retaining member attached to the shank for retaining the tool elements about the shank.

10. The socket wrench of claim 9 wherein the head supports a ratchet assembly for selectively ratcheting the drive shaft in response to rotation of the head.

11. The socket wrench of claim 9 wherein the drive shaft engages a first socket of a first tool element and a fastener engages a second socket of the first tool element, the first and second sockets contiguously forming a longitudinal bore through the tool element, wherein the journal surface is adapted to be disposed within the longitudinal bore.

12. The socket wrench of claim 11 wherein the journal surface comprises a substantially cylindrically-shaped surface having a substantially circular cross-section that is adapted for journalling the first socket of the tool element, wherein the first socket is substantially squarely-shaped.

13. The socket wrench of claim 12 wherein the journal surface has a diameter adapted for journalling the first socket provided substantially as a ¼ inch squarely-shaped socket.

14. The socket wrench of claim 12 wherein the journal surface has a diameter adapted for journalling the first socket provided substantially as a ½ inch squarely-shaped socket.

15. The socket wrench of claim 12 wherein the journal surface has a diameter adapted for journalling the first socket provided substantially as a ¾ inch squarely-shaped socket.

16. The socket wrench of claim 11 wherein the journal surface comprises a substantially cylindrically-shaped surface having a substantially circular cross-section that is adapted for journalling the second socket of the tool element, wherein the second socket is substantially polygonally-shaped.

17. The socket wrench of claim 9 wherein the retaining member comprises:

a post adapted for a threading engagement with the shank; and a shoulder depending from the post to abuttingly limit a longitudinal movement of the tool element in order to retain the tool element in the journalled engagement about the shank.

18. The socket wrench of claim 9 wherein the retaining member comprises:

a post adapted for a frictional engagement with the shank; and a shoulder depending from the post to abuttingly limit a longitudinal movement of the tool element in order to retain the tool element in the journalled engagement about the shank.

19. The socket wrench of claim 18 wherein the shoulder rotates relative to the post about a pin wearingly passing through the head and fixed to the post so that the shoulder freely rotates about the pin.

20. The socket wrench of claim 18 wherein the shank supports a pin that traverses a slot provided in the post and is receivingly disposed in a retention detent at a distal end of the slot, and wherein a bias member urges the pin to remain in the retention detent.

21. A method for storing spare tool elements on a socket wrench in a manner providing a handle with a rotatable grip surface, comprising the steps of:

providing a socket wrench with a journal surface on an extending shank;

journalling a tool element about the journal surface; and attaching a retaining member to the shank to retain the tool element about the journal surface.

22. The method of claim 21 further comprising the step of journalling a plurality of tool elements about the journal surface prior to attaching the retaining member to the shank.

23. A socket wrench adapted to facilitate a neutral wrist position during use of the socket wrench, comprising:

a plurality of tool elements;

a head having a drive shaft connectable to the tool elements for interchangeable coupling engagement with one of the plurality of tool elements, an elongated shank extending substantially transversely from the head and supportingly storing the plurality of tool elements so as to permit an operator to grasp the tool elements and rotate the tool elements about the shank; and a retaining member attached to the shank for retaining the tool elements on the shank while permitting the tool elements to rotate about the shank providing a rotatable grippable surface.

24. A socket wrench adapted to facilitate a neutral wrist position during use of the socket wrench, comprising:

a plurality of tool elements, each tool element having a bore;

a head having a drive shaft connectable to the tool elements for interchangeable coupling engagement with a selected tool element of the plurality of tool elements;

an elongated shank, extending from the head, the elongated shank having an abutment at a proximal end thereof;

a retaining member connected to a distal end of the shank and having a shoulder, wherein a plurality of non-selected tool elements of the plurality of tool elements is supportingly engaged by a disposition of the shank within the bore of each non-selected tool element so that the non-selected tool elements are retained on the shank between the abutment of the shank and the shoulder of the retaining member while permitting the non-selected tool elements to freely rotate about the shank.

* * * * *